United States Patent [19]

Bergman

[11] 4,406,220

[45] Sep. 27, 1983

[54] REFUSE HANDLING SYSTEM

[75] Inventor: Hans Bergman, Johanneshov, Sweden

[73] Assignee: Termic Instrument AB, Huddinge, Sweden

[21] Appl. No.: 254,255

[22] Filed: Apr. 15, 1981

[30] Foreign Application Priority Data

Apr. 28, 1980 [SE] Sweden ..... 8003186

[51] Int. Cl.[3] ..... B30B 15/16

[52] U.S. Cl. ..... 100/49; 100/98 R; 198/747; 100/256

[58] Field of Search ..... 100/49, 179, 215, 256, 100/45, 98 R, 906, 48; 198/747

[56] References Cited

U.S. PATENT DOCUMENTS

| | | | |
|---|---|---|---|
| 931,536 | 8/1909 | Weilan | 198/747 |
| 3,213,783 | 10/1965 | May et al. | 100/906 |
| 3,604,345 | 9/1971 | Boje | 100/98 R |
| 3,802,335 | 4/1974 | Longo | 100/49 |

*Primary Examiner*—Billy J. Wilhite

*Attorney, Agent, or Firm*—Browdy and Neimark

[57] ABSTRACT

A refuse handling system for transporting refuse from the lower end of a refuse disposal chute, for example, to a location adjacent the outer wall of a building. The system includes a straight elongate tubular chamber of substantially uniform cross section and open at one end. The chamber includes a refuse-infeed section in spaced relation to the open end and a refuse-compression section located closest to and communicating with the open end. A refuse infeed opening is provided in the wall of the chamber to the refuse-infeed section. A refuse conveying pipe having a larger cross sectional area than that of the chamber is connected to the open end of the chamber. The opposite end of the conveying pipe is connected to a remotely located refuse receiving station. A ram means is axially movable in the chamber to push the refuse from the refuse infeed section to the refuse compression section of the chamber, the ram means subsequently compressing the refuse in the refuse compression section and causing the refuse to pass into the refuse conveying pipe, through which the refuse passes to the remotely located refuse receiving station.

7 Claims, 1 Drawing Figure

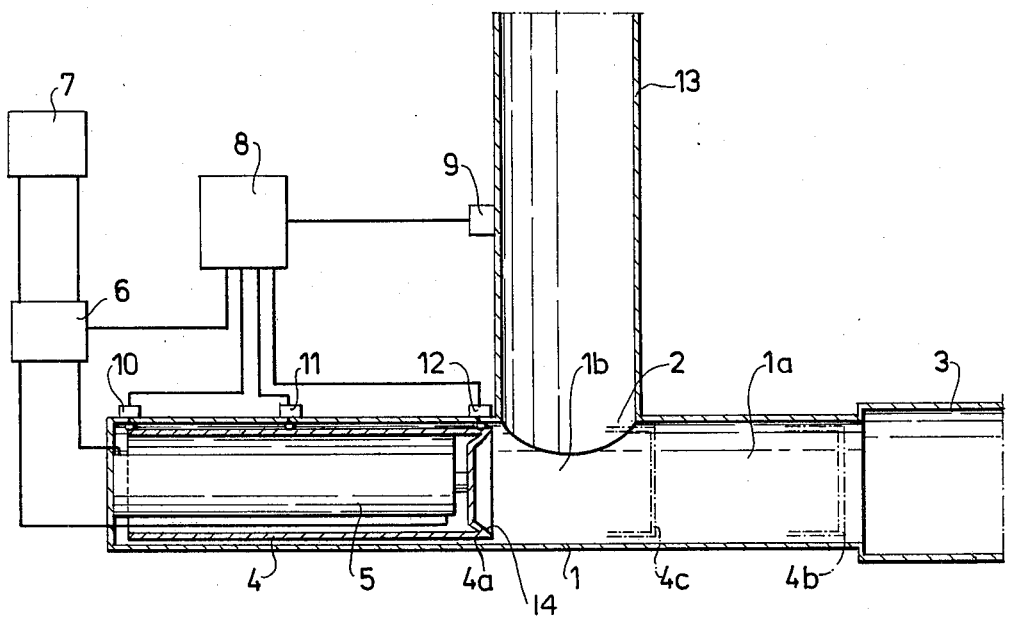
7
8
9
13
6
10
11
12
1b
2
1a
3
4
5
4a
14
1
4c
4b

REFUSE HANDLING SYSTEM

The present invention relates to a refuse or garbage handling system for transporting refuse and waste within a building, in particular a building provided with a refuse disposal chute.

In buildings provided with refuse disposal chutes, and in particular older buildings, the collection of refuse from a refuse collecting room located at the lower end of the chute is both troublesome and time consuming, and requires comprehensive manual handling of the refuse. The same problem prevails in other contexts, for example in the kitchens of restaurants, which are often so located within a tenement building that collection of the large quantities of kitchen refuse and waste requires comprehensive and troublesome manual handling of the refuse. It would therefore be desirable in these cases and similar cases, to have available a system which automatically conveys the refuse from, for example, the lower end of a refuse disposal chute or from the kitchen of a restaurant located within a tenement building to a refuse collecting room located adjacent an external wall of the building, which is readily accessible to refuse collecting trucks, or directly to a refuse transport container placed outside the outer wall of said building or in a space which is directly accessible from the outside of said building. Refuse handling systems for this purpose have previously been proposed, in which the refuse is compressed at the lower end of a refuse disposal chute or the like and forced by means of a reciprocating plunger through a conveying pipe extending from the chute or the like to the collecting space at the outer wall of said building, where the refuse can be readily collected. The requisite driving force for conveying the refuse through the conveying pipe is obtained by means of a reciprocatingly movable plunger, which is arranged at the infeed end of the conveying pipe and which is arranged to exert a force on the refuse and waste last fed into the pipe, so that said pressure force is propagated through the whole of the waste located in said pipe, thereby causing said waste to move through the pipe. With known refuse handling systems of this kind it has been found, however, that the friction between the refuse and the inner surfaces of the conveyor pipe is so great that with a plunger of moderate size the pressure force exerted thereby is only able to convey the refuse through a relatively short pipe. If attempts are made to convey refuse in this way through longer pipes, they readily become blocked.

The object of the present invention is therefore to provide an improved refuse handling system of the afore-described kind which enables refuse to be conveyed through pipes of considerably longer lengths without risk of the pipes becoming blocked.

To this end there is proposed in accordance with the invention a refuse handling system comprising a first straight elongate element of substantially uniform cross-section throughout and including a refuse-infeed section and a refuse-compression section; a refuse-infeed opening in a wall of said first elongate element substantially above the refuse infeed section thereof, a second elongate element connected at one end thereof to the refuse-compression section of said first elongate element and at the other end to a refuse receiving station, the length and cross-sectional are of the second elongate element being greater than the length and cross-sectional area of the first elongate element; ram means axially movable in the first elongate element and having a cross-sectional shape and area which coincide substantially with those of said first elongate element; and ram drive means for moving said ram means axially in said first elongate element in a given sequence of working strokes, from a withdrawn position in which the refuse-infeed opening is exposed to a fully extended position well within the compression section of said first elongate element.

dr

An examplary embodiment of a refuse handling system according to the invention will now be described in more detail with reference to the accompanying drawing.

The single FIGURE is a cross sectional view of the refuse handling system.

The illustrated embodiment comprises a straight, substantially horizontally arranged pipe 1 provided in the upper part of its wall with a refuse infeed opening 2 connected to the lower end of the refuse disposal chute, a refuse filling shaft or the like 13. The pipe 1 is connected at one end thereof, on one side of the infeed opening 2, with a pipe 3 for conveying the refuse over a considerable distance to a collecting station, from where the refuse can be readily collected, as described in the aforegoing.

Arranged in the other end of the pipe 1, on the opposite side of the infeed opening 2, is a plunger 4 which can be moved forwards and backwards in the pipe 1 by means of a double-acting hydraulic cylinder 5. This end of the pipe 1 is suitably sealingly closed, to reduce the risk of fire and the permeation of ill-smelling gases from the refuse or garbage. The length of stroke of the plunger 4 is such that it can be moved axially from the fully withdrawn position shown in full lines in the drawing and referenced **4*a* to a maximally extended position shown in chain-lines and referenced 4*b*. The plunger has the form of a sleeve having a closed front end wall and an axial length such that it will still close the infeed opening 2 of the pipe 1 when occupying its maximally extended position 4*b*. The front end of the plunger is preferably formed as ring-shaped cutting means 14**

The two sides of the hydraulic cylinder 5 are connected in a conventional manner, via a directional valve 6, to a suitable hydraulic unit 7 comprising, i.a. a hydraulic pump and a tank for hydraulic working fluid. The directional valve 6 can be operated through a program unit or control unit 8 activated by signals from a photocell arrangement 9 or the like located in the filling shaft 13 at a distance above the infeed opening 2 of the pipe 1, and a number of limit switches 10,11 and 12 arranged to detect the position of the plunger 4.

As will be seen from the drawing, the refuse conveying pipe 3 has a somewhat larger diameter than the pipe 1 in which the plunger 4 operates. The pipe 1 has substantially the same diameter as the plunger 4. That part, **1*a*, of the pipe 1 located between the infeed opening 2 and the beginning of the conveying pipe 3 and into which the plunger 4 can be moved axially to the maximally extended position 4*b* is of considerable length and forms a refuse-compression chamber, while that part 1*b* of the pipe located immediately beneath the infeed opening 2** can be considered to form solely a refuse infeed chamber.

The system has the following mode of operation:

In the rest position of the system the plunger 4 is suitably extended at least to the position shown at **4*c*, i.e. at least a small distance into the part 1*a* of the pipe 1, so that the plunger closes the infeed opening 2 of the pipe 1. This decreases the risk of fire and spreading of ill-smelling gases. Subsequent to the control unit 8 having extablished through the influence. of signals from the photo-cell arrangement 9, that a given quantity of refuse has fallen down through the shaft 13, for example a given number of bags filled with refuse or an amount of refuse such that the refuse in the filling shaft 13 reaches to the level of the photocell arrangements 9, the control unit 8 initiates a predetermined working sequence of the plunger 4, by resetting the hydraulic directional valve 6. This working sequence is begun by withdrawing the plunger 4 back to its fully withdrawn position 4***a*, which is detected by means of the limit switch 10, therewith exposing the infeed opening 2 such that part of the refuse in the shaft 13 falls down into the infeed chamber 1*b* of the pipe 1. The plunger 4 is then caused to execute a given number of short working strokes until it reaches the position shown at 4*c*, the plunger being detected in this position by means of the limit switch 11. In this way, the refuse is pushed into the compression chamber 1*a* of the pipe 1 without being compressed to any appreciable extent. Subsequent to all, or at least a large part of the refuse in the filling shaft 13 having been fed into the compression chamber 1*a* of the pipe 1 by means of the aforedescribed short plunger strokes, the plunger 4 is caused to execute a maximum working stroke up to its maximally extended position 4*b*, which is detected by means of the limit switch 12. During this maximum working stroke, or compression stroke, the refuse fed into the compression chamber 1*a* by means of the aforesaid short working strokes is substantially compressed, since during said maximum working stroke the compression chamber 1*a* is closed on one side by the plunger 4 and on the other side by means of previously compressed refuse present in the conveying pipe 3. The refuse compressed in this manner in the compression chamber 1*a* is forced by the pressure from the plunger 4 out into the conveying pipe 3, and forwardly displaces the refuse already present in the conveying pipe, so as to convey compressed refuse through said pipe. The diameter of the refuse compressed in the compression chamber 1*a* of the tube 1 will be smaller than the diameter of the conveying pipe 3, so that the friction exerted by the refuse against the surface of the wall of the pipe 3 is much smaller than would otherwise be the case. Domestic waste has mainly a composition such that it will only slightly expand radially when pressed out of the pipe 1 into the conveying pipe 3 of larger diameter. Because of this reduced friction between the refuse and the inner surface of the wall of the pipe 3, it is possible, when using a system according to the invention, to readily convey refuse through a conveying pipe 3 of significant length without risk of the pipe becoming blocked.

As will be understood, the length of the compression chamber 1*a* can be varied as desired, as can also the distance between the maximally extended position 4*b* of the plunger 4 and the commencement of the conveyor pipe 3 of larger diameter, so that the refuse can be compressed to the extent desired within the compression chamber 1*a*, without risk of stopping the conveying movement of the refuse and overloading the drive means of the plunger 4.

In a system constructed in accordance with the invention, the pipe 1 may, for example, have a diameter of 30 cm, and the conveying pipe 3 a diameter of about 35 cm. In this case, the axial length of the compression chamber 1*a* may, for example, be from 70 to 100 cm.

The forward end of the plunger 4 may suitably be provided with a ring-shaped cutting edge around its circumference, said edge being arranged to cut any refuse which becomes clamped between the forward end of the plunger and the edge of the infeed opening 2. This cutting may, to advantage, be replaceable.

It will be understood that the illustrated examplary embodiment of the invention is not limitive, but that other embodiments and modifications of a refuse handling system according to the invention are conceivable within the scope of the claims. Thus, as will be understood, the plunger drive means and the control unit by which the drive means are controlled may have many different forms.

I claim:

1. A refuse handling system comprising a straight elongate tubular chamber having a substantially uniform cross-section over its entire length and one open end and including a refuse-compression section located closest to said open end and a refuse-infeed section located on the opposite side of said refuse-compression section relative to said open end; a refuse-infeed opening in a wall of said chamber to said refuse-infeed section; a refuse-conveying pipe having one end connected to said open end of said chamber and an opposite end connected to refuse receiving station which is remotely located relative to said chamber, the cross-sectional area of said refuse-conveying pipe being substantially larger than the cross-sectional area of said chamber; ram means axially movable within said chamber and having a cross-sectional shape and area coinciding with those of said chamber and a ram face facing said open end of said chamber; ram drive means for reciprocatingly moving said ram means within said chamber; position detecting means for detecting the position of said ram face within said chamber; and control means responsive to said position detecting means for actuating said ram drive means to drive said ram means through an operation sequence consisting of a number of short reciprocating ram strokes between a fully withdrawn ram position, in which said ram face is located on the opposite side of said refuse-infeed opening relative to said open end, and an intermediate ram position. in which said ram face is located just beyond said refuse-infeed section as seen from said fully withdrawn ram position, and a subsequent final ram stroke to a fully extended ram position, in which said ram face is located well within said refuse-compression section at a substantial distance from said refuse-infeed opening and adjacent said open end of said chamber.

2. A system as claimed in claim 1, wherein said ram means closes said refuse-infeed opening when in said intermediate or said fully extended ram positions.

3. A system as claimed in claim 1, wherein said tubular chamber is substantially horizontal and said refuse-infeed opening is located in an upper wall of said chamber.

4. A system as claimed in claim 3, wherein said refuse-infeed opening is connected to the lower end of a refuse dispose chute.

5. A system as claimed in claim 4, wherein said control means include refuse-sensing means located in said refuse chute above said refuse-infeed opening for sensing the amount of refuse present in said chute and for initiating said operation sequence when a given quantity of refuse is present in said chute.

6. A system as claimed in claim 1, wherein said ram face is provided with an axially projecting cutting edge along the periphery of the ram face.

7. A system as claimed in claim 1, wherein said ram means has a rest position when not performing said operation sequence, in which rest position said ram face is located within said refuse-compression section.

* * * * *